US007311617B2

(12) United States Patent
Langhorn

(10) Patent No.: US 7,311,617 B2
(45) Date of Patent: Dec. 25, 2007

(54) TRAINING DEVICE FOR BALL GAMES

(75) Inventor: Jesper Langhorn, Copenhagen (DK)

(73) Assignee: Global Goal ApS (DK)

( * ) Notice: Subject to any disclaimer, the term of this patent is extended or adjusted under 35 U.S.C. 154(b) by 0 days.

(21) Appl. No.: 10/491,340

(22) PCT Filed: Oct. 1, 2002

(86) PCT No.: PCT/DK02/00649

§ 371 (c)(1),
(2), (4) Date: Jun. 30, 2004

(87) PCT Pub. No.: WO03/028812

PCT Pub. Date: Apr. 10, 2003

(65) Prior Publication Data

US 2004/0242347 A1 Dec. 2, 2004

(30) Foreign Application Priority Data

Oct. 1, 2001 (DK) ..... 2001 01429

(51) Int. Cl.
*A63B 69/00* (2006.01)
*A63B 63/00* (2006.01)

(52) U.S. Cl. ..... 473/446; 273/400; 473/478

(58) Field of Classification Search ..... 273/398–402; 473/197, 476–479, 446
See application file for complete search history.

(56) References Cited

U.S. PATENT DOCUMENTS

| | | | | |
|---|---|---|---|---|
| 611,504 | A * | 9/1898 | Perky | 273/400 |
| 1,211,379 | A * | 1/1917 | Maisch | 273/368 |
| 3,134,594 | A * | 5/1964 | Crowley | 273/350 |
| 3,201,126 | A * | 8/1965 | Nissen | 273/393 |
| 4,569,515 | A * | 2/1986 | Gordon | 473/473 |
| 5,096,191 | A * | 3/1992 | Fang | 473/485 |
| 5,123,656 | A | 6/1992 | Green | |
| 5,524,881 | A * | 6/1996 | Edward | 473/447 |

(Continued)

FOREIGN PATENT DOCUMENTS

| | | | |
|---|---|---|---|
| DK | 94 00021 | U3 | 3/1994 |
| EP | 0 884 075 | | 12/1998 |
| EP | 0 884 075 | A2 | 12/1998 |
| FR | 2651141 | * | 8/1989 |
| HU | 222429 | B | 7/2003 |
| HU | P010347 | A | 7/2003 |
| HU | P0200424 | | 1/2004 |
| JP | 9038259 | | 2/1997 |
| JP | 11 299922 | | 11/1999 |
| WO | 01/37948 | | 5/2001 |

OTHER PUBLICATIONS

"Soccer Target", Recreation, Sports & Leisure, Apr. 1985. p. 18.*

*Primary Examiner*—Mark S Graham
(74) *Attorney, Agent, or Firm*—Renner, Otto, Boisselle & Sklar, LLP

(57) ABSTRACT

A training device for ball games having a first ring member arranged in a first plane and a second ring member arranged in a second plane substantially parallel to the first plane. A plurality of bars connect the first and second ring members to each other, so that a plurality of openings are defined between the ring members and the bars. The device provides openings defined by the ring members and the bars in all directions when the device is placed with one of the ring members resting on the ground. Thus it is possible for several persons to train at the same time since each person is allowed to use a respective one of the openings. At least one net is suspended across the inner space to catch the ball.

24 Claims, 10 Drawing Sheets

U.S. PATENT DOCUMENTS 5,536,003 A * 7/1996 Brenner ..... 473/481
5,722,446 A * 3/1998 Zheng ..... 135/125
5,989,130 A 11/1999 Macaluso
6,287,226 B1 9/2001 Dilling
6,780,129 B1 * 8/2004 Higuchi ..... 473/447
2003/0008721 A1 * 1/2003 Macaluso ..... 473/197
2003/0025272 A1 * 2/2003 Billig et al. ..... 273/400
2004/0214666 A1 10/2004 Dilling

* cited by examiner

TRAINING DEVICE FOR BALL GAMES

This is a nationalization of PCT/DK02/00649 filed Oct. 1, 2002 and published in English.

BACKGROUND OF THE INVENTION

1. Field of the Invention

The invention relates to a training device for ball games.

2. Description of the Related Art

Many ball games make use of one or more goals into which e.g. a ball or a puck has to be thrown or kicked. As examples of such ball games, football, handball and ice hockey may be mentioned. Typically, well-known goals have a single rectangular opening, while they are closed by e.g. nets, plates or sheets on the other sides. While this is intended and expedient during ball matches and tournaments, it is less expedient for training purposes, especially for ball handling exercises, due to the very fact that it can only be used from one side at a time, and thus it is not possible for several persons to use the goal simultaneously for training purposes.

EP 884 075 shows a double goal, which can be used from two opposing sides due to its two well-defined openings. Between the two openings the double goal is closed by a rebound-material which ensures that the ball is returned to the playing ground if it hits the goal but not one of the two goal openings. Also a round embodiment is closed by a rebound-material between two well-defined openings. Although this goal is an improvement compared to the traditional single-sided goal, because it allows two persons to train simultaneously, there is still a need for a training device which can be used by a larger number of persons training at the same time.

Therefore, it is an object of the invention to provide a training device which can be used from several directions simultaneously.

SUMMARY OF THE INVENTION

According to the invention the object is achieved in that the device comprises a first ring member arranged in a first plane, a second ring member arranged in a second plane being substantially parallel to said first plane, and a number of bars connecting said first and second ring members to each other, so that a number of openings are defined between the ring members and the bars.

Such a device provides openings defined by the ring members and the bars in all directions when the device is placed with one of the ring members resting on the ground. Thus it is possible for several persons to train at the same time since each person is allowed to use a respective one of the openings. Further, the opening in the other ring member can also be used by persons training to drop the ball through a horizontal opening. When the device is placed with the planes of the ring members in a substantially vertical position the device may be rolled across the ground, which allows training in hitting a movable goal.

When the device further comprises at least one net arranged to catch a ball hitting one of said openings, said net being suspended in the space between said first and second ring members, it is avoided that balls pass through the device, which would otherwise cause inconvenience to the persons using the device from the other directions. Further, the nets may define additional openings thus allowing an even larger number of simultaneous users.

In one embodiment, nets are arranged in planes substantially perpendicular to the plane of at least one ring member. This location of the nets is expedient for catching the balls from different directions.

Alternatively or additionally a net may be arranged between the peripheries of said first and second ring members. In addition to catching balls from different directions this net could also ensure that only balls hitting the opening of one of the ring members can enter the inner space of the device.

In an expedient embodiment, at least one of said ring members has a circular shape. With this shape it is easier to roll the device, either during training with a movable goal or during transportation of the device. Alternatively, at least one of said ring members is polygon-shaped. A device with polygon-shaped ring members may be easier to manufacture. Other shapes, including combinations of the above, are also possible.

Said first and second ring members may have substantially the same size. In most situations this is a practical embodiment because of the regular shape of the openings in the device. Further, this shape of the device also facilitates the rolling of the device.

It is expedient when one of said first and second ring members is sufficiently heavy to ensure the stability of the device when the device is placed with said one ring resting on a substantially horizontal surface.

Said first and second ring members may also have different sizes. Typically, such a goal will be placed with the smaller opening at the top. A smaller opening at the top may be an advantage when training to hit a horizontal opening with the ball.

The device may further comprise a supporting base arranged at a distance from said first and second planes. This allows the device to be lifted from the ground in order to increase the level of difficulty when the horizontal opening is to be hit with the ball.

When the ring members of the device are of different sizes, it may further comprise a net formed as a basket and mounted on the smaller one of said first and second ring members. Such a net guides a ball hitting the horizontal opening to the interior of the device.

When the first and second ring members are of the same size, the device may further comprise a third ring member arranged in a third plane being substantially parallel to said first and second planes, said third ring member being smaller than said first and second ring members. This allows a combination of the training options mentioned above.

An expedient embodiment of the training device is achieved when said first, second and third ring members are circular-shaped and arranged coaxially, said first and third ring members are connected to each other by a number of straight connecting bars, said second ring member is arranged between the first and third ring members and is connected to the straight connecting bars by side bars, nets are arranged between the first and second ring members in planes substantially perpendicular to the plane of at least one ring member, a net is arranged between the peripheries of said second and third ring members, and a net formed as a basket is mounted on the third ring member.

BRIEF DESCRIPTION OF THE DRAWINGS

The invention will now be described more fully below with reference to the drawing, in which.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
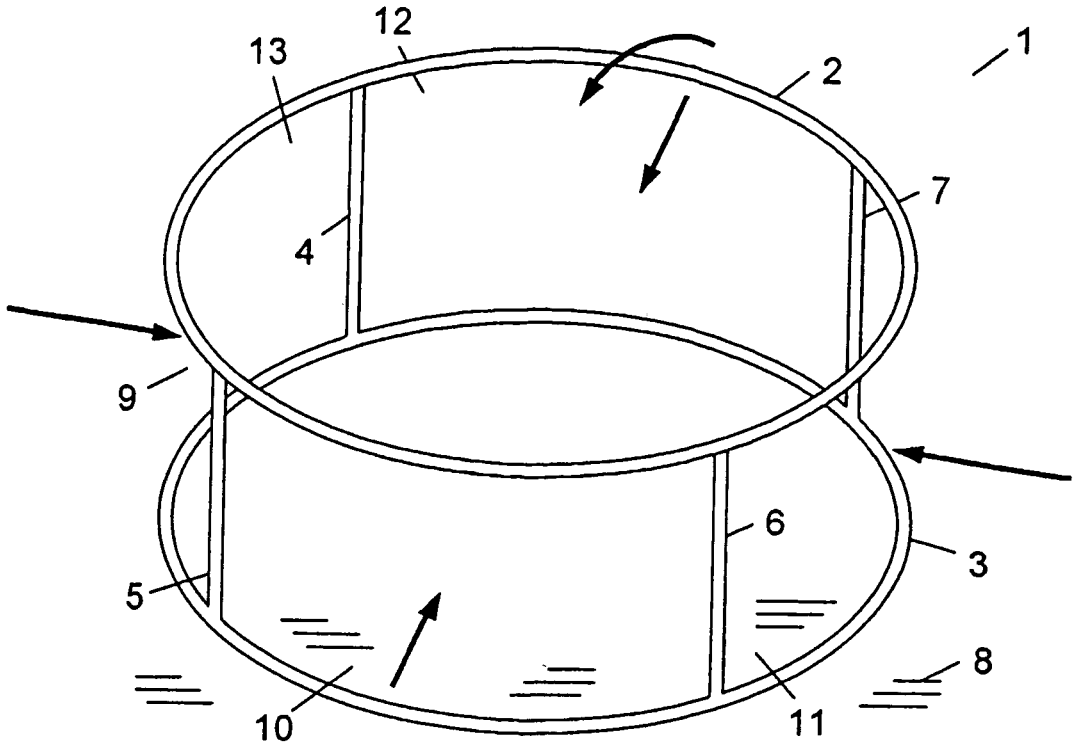
FIG. 1 shows a first embodiment of a training device having two ring members connected to each other by supporting bars.

A first example of a training goal or training device 1 according to the invention is illustrated in FIG. 1. In this example the device 1 is constructed of two circular ring members 2, 3 having substantially the same size. The two ring members 2, 3 are connected to each other by four connecting bars 4, 5, 6, 7 such that the two ring members are arranged in two parallel planes having a distance corresponding to the length of the connecting bars.

When the device 1 is placed with the ring 3 resting on the ground 8, as it is shown in FIG. 1, the ring members 2, 3 and the connecting bars 4, 5, 6, 7 define four openings 9, 10, 11, 12 each of which can be used as a separate goal during training with e.g. ball handling exercises. Arrows indicate the directions in which a ball may be thrown or kicked into the four goal openings 9, 10, 11, 12. Further, the circular opening 13 in the upper ring member 2 may also be used in training exercises in which the ball has to hit a horizontal opening, as is also indicated by an arrow.

The training device 1 may be made of any suitable material, such as steel or other metals, wood or a synthetic material, such as plastic. However, at least the ring member 3 should be made of a material sufficiently heavy to ensure the stability of the device when it is placed in the position illustrated in FIG. 1. Alternatively, the lower ring may be provided with other means for securing the device to the ground, such as spikes or pegs. The dimensions of the device may vary depending on the type of training or type of ball game for which it is to be used. There may also be used different sizes for children and for grown-up people. A typical size for a device intended for children training football may be a diameter of the ring members of 1.5 to 2 meters and a distance between the rings of 1.2 to 1.5 meters.

Figure 2:
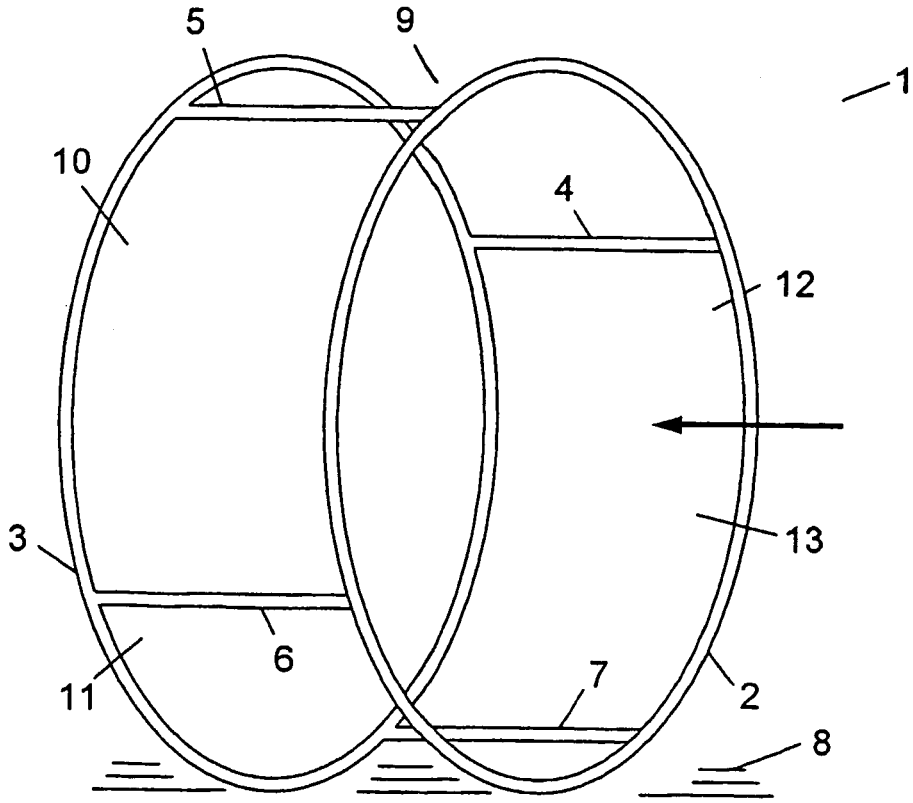
FIG. 2 shows the device of FIG. 1 in a tilted position.

The training device of FIG. 1 can easily be moved to another place by tilting to a vertical position as shown in FIG. 2. In this position the device can be rolled to the new place, where it is tilted back to the position of FIG. 1. However, the device can also be used for training purposes in the position shown in FIG. 2. In a stationary position, especially the circular opening 13 defined by the ring member 2 can be used as a round goal. Again an arrow indicates the direction of a ball. More interestingly, however, the opening 13 can be used as a goal while the device is rolled by another person, which allows a player to perform the exercise of hitting a movable goal. Even the openings 9, 10, 11, 12 may be used as movable goals while the training device is rolled.

Figure 3:
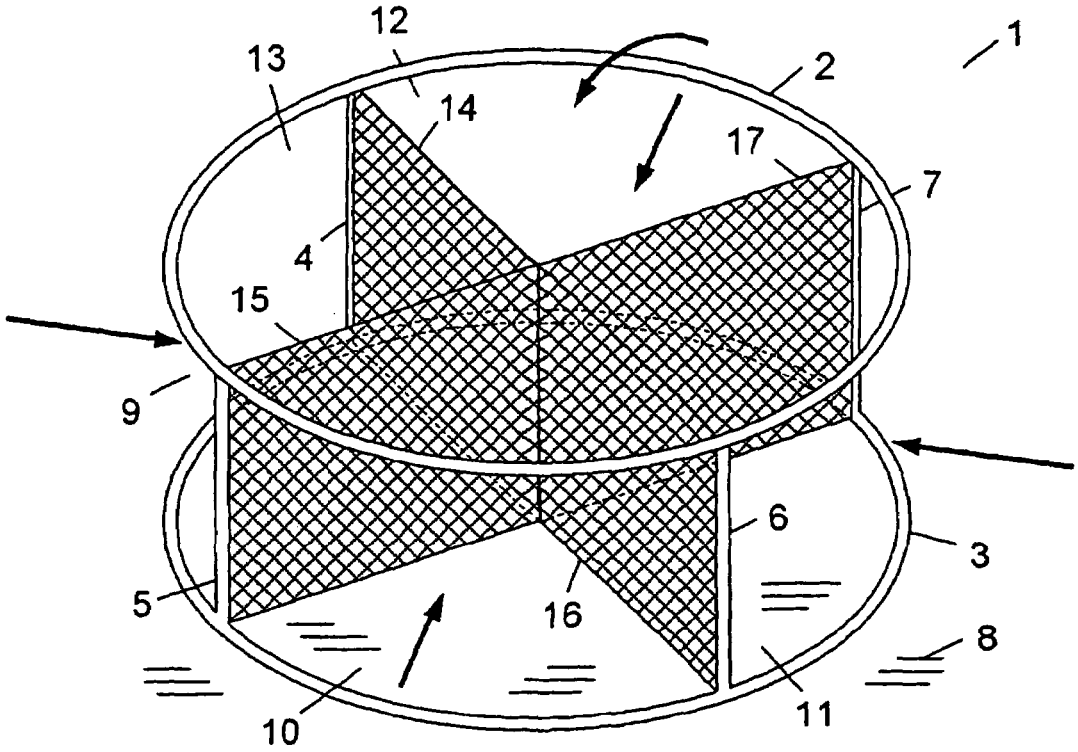
FIG. 3 shows the device of FIG. 1 provided with four nets.

As shown in FIG. 3, the training device 1 may also be provided with nets 14, 15, 16, 17, which further improves the training value of the device. The nets are attached to the connecting bars 4, 5, 6, 7 and/or the ring members 2, 3 at the periphery of the rings, and in the middle of the device the four nets are connected to each other. The height of the nets correspond to that of the connecting bars 4, 5, 6, 7. The nets ensure that balls hitting one of the goal openings 9, 10, 11, 12 are caught, and thus they cannot pass through the device and cause inconvenience to the persons using the device from the other directions. They also ensure that the goals of the device are more well defined. Thus as an example one goal with the goal opening 10 is defined by the two ring members 2, 3, the bars 5, 6 and the two nets 15, 16. Of course the top of the device defined by the upper ring 2, i.e. the opening 13, may also be closed by a net, but normally it will be more expedient to leave this opening open and also use this opening for training purposes as described above. This training is even further improved because the four nets 14, 15, 16, 17 now divide this opening into four separate openings that can be used individually.

Figure 4:
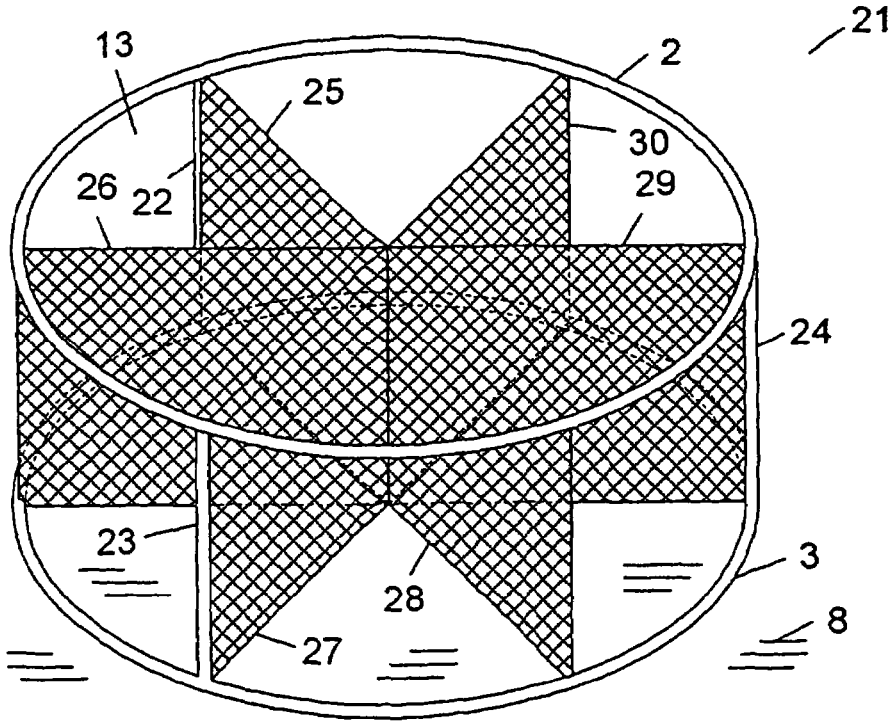
FIG. 4 shows a training device provided with six nets.
Figure 5:
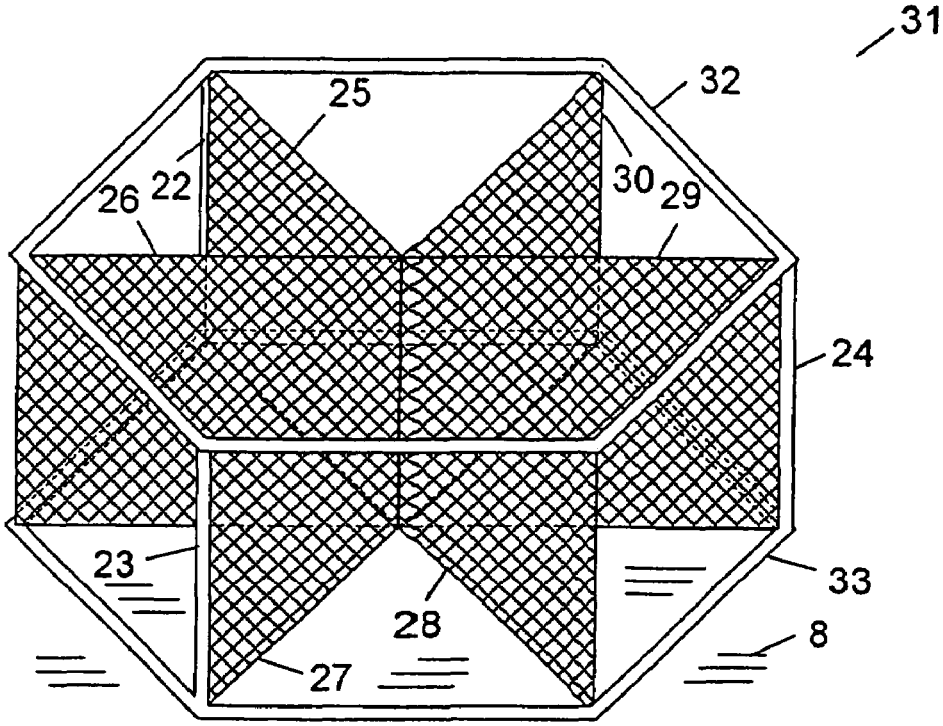
FIG. 5 shows a hexagonal training device.

In FIG. 3 the four nets 14, 15, 16, 17 are shown aligned with the connecting bars 4, 5, 6, 7, which is often a convenient solution. However, the nets, or some of them, may also be mounted in other ways in relation to the bars. Thus they may instead be used to subdivide the goals defined by the openings 9, 10, 11, 12, or the connecting bars may simply be used solely for the connection of the ring members to each other independent of the goal openings, which are then defined by the nets. Further, the number of nets need not be the same as the number of connecting bars. This is illustrated in FIG. 4 showing a device 21 having three connecting bars 22, 23, 24 and six nets 25, 26, 27, 28, 29, 30. Here, six goal openings are provided by the nets and the ring members although only three connecting bars are used. However, it will often be convenient to align each bar with one of the nets, as it is also shown here.

In the embodiments described above, the ring members 2, 3 have a circular shape. However, many other shapes of the ring members can be used as well. Thus, as examples, also elliptical- or polygon-shaped ring members could be used. One example of polygon-shaped ring members is shown with the training device 31 having hexagonal ring members 32, 33. Except for the hexagonal ring members 32, 33 the construction and the function of the device 31 is similar to that of the device 21 in FIG. 4. It should be noted that polygon-shaped ring members need not be equilateral, i.e. the sections of the polygon could have different lengths. The ring members could also be composed of straight sections in combination with sections formed as sectors of a circle, as long as the complete ring member constitutes a closed curve.

Figure 6:
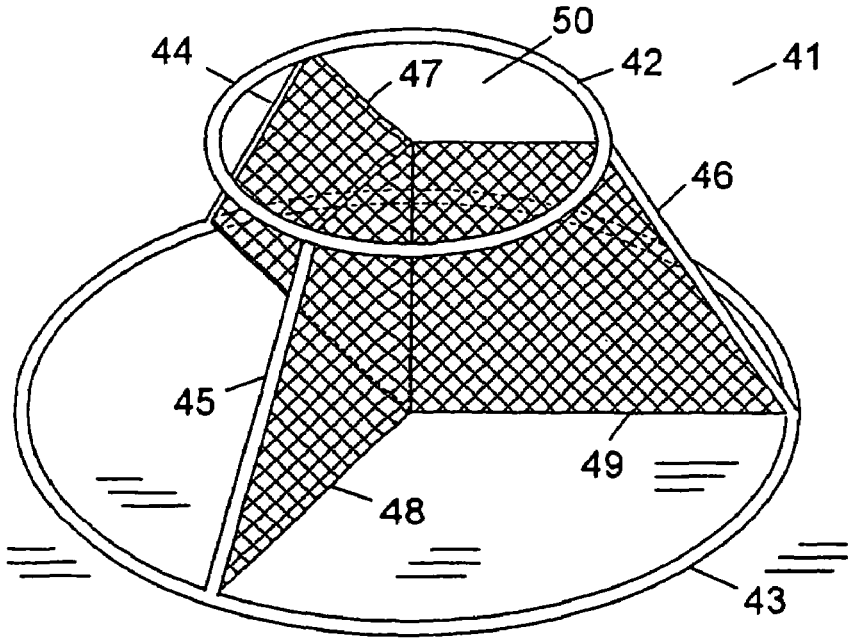
FIG. 6 shows a training device with ring members having different sizes.

As shown in FIG. 6, the ring members may also have different sizes. The training device 41 has a smaller upper ring member 42 and a larger lower ring member 43 connected to each other by the three connecting bars 44, 45, 46.

Figure 7:
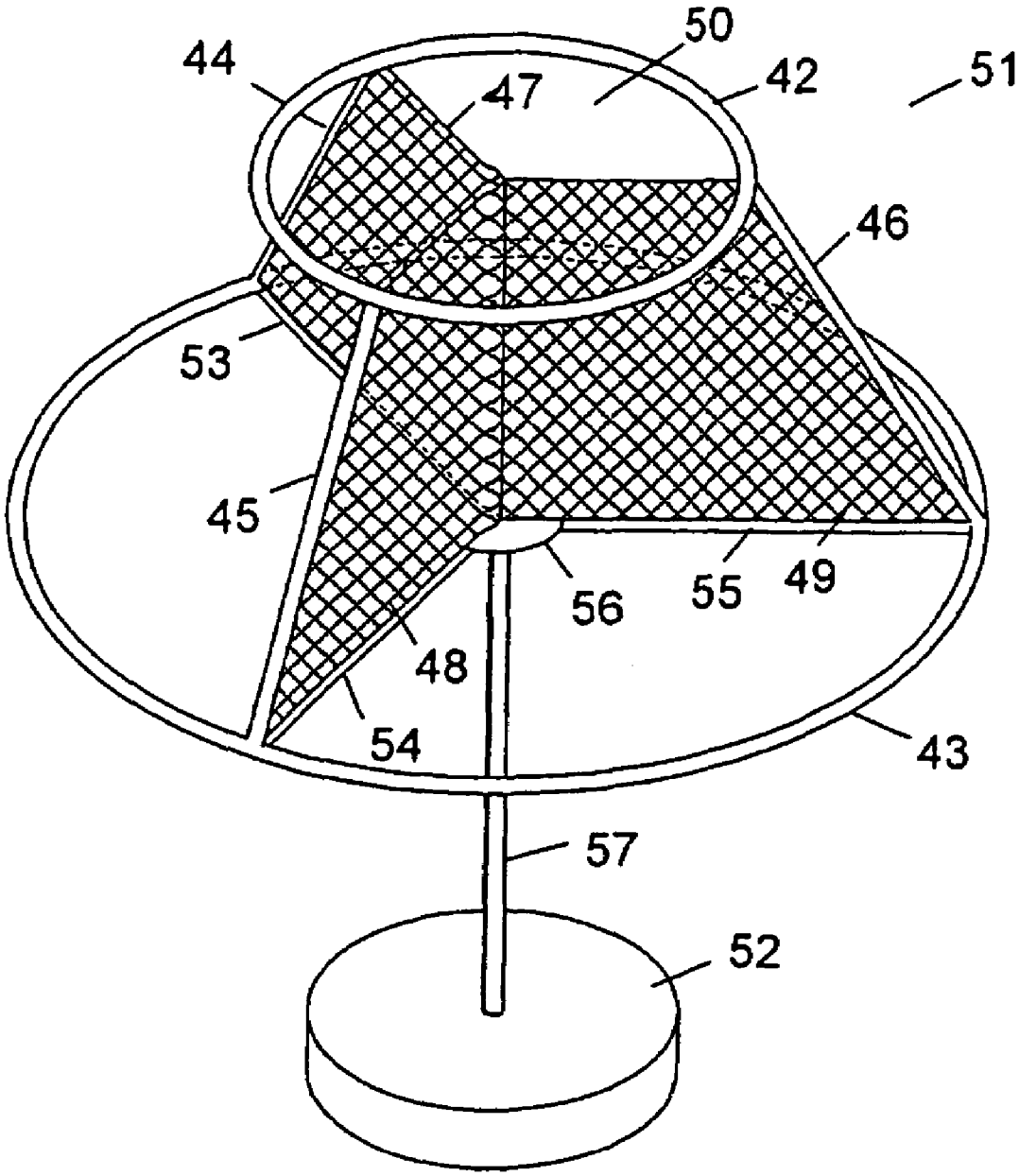
FIG. 7 shows the device of FIG. 6 mounted on a base.

In this case only three nets 47, 48, 49 are used, thus defining three goal openings. The advantage of this embodiment is that the smaller upper ring makes it more difficult to hit the upper horizontal opening 50, which is even divided into three subsections by the nets 47, 48, 49. Thus a more demanding training is provided. The training may be even more demanding if the training device is elevated to a higher position, which is illustrated in FIG. 7. The training device 51 is similar to the device 41, but it is mounted on a foot or base 52. Three horizontal bars 53, 54, 55 connect the lower ring member 43 to a central plate 56 which rests on a vertical supporting bar 57. The lower end of the vertical bar 57 is mounted in the foot 52, which has to be quite heavy in order to ensure the stability of the training device. The training device 51 is used in the same way as the previous embodiments, but the higher level of the goal openings makes the training more demanding.

Figure 8:
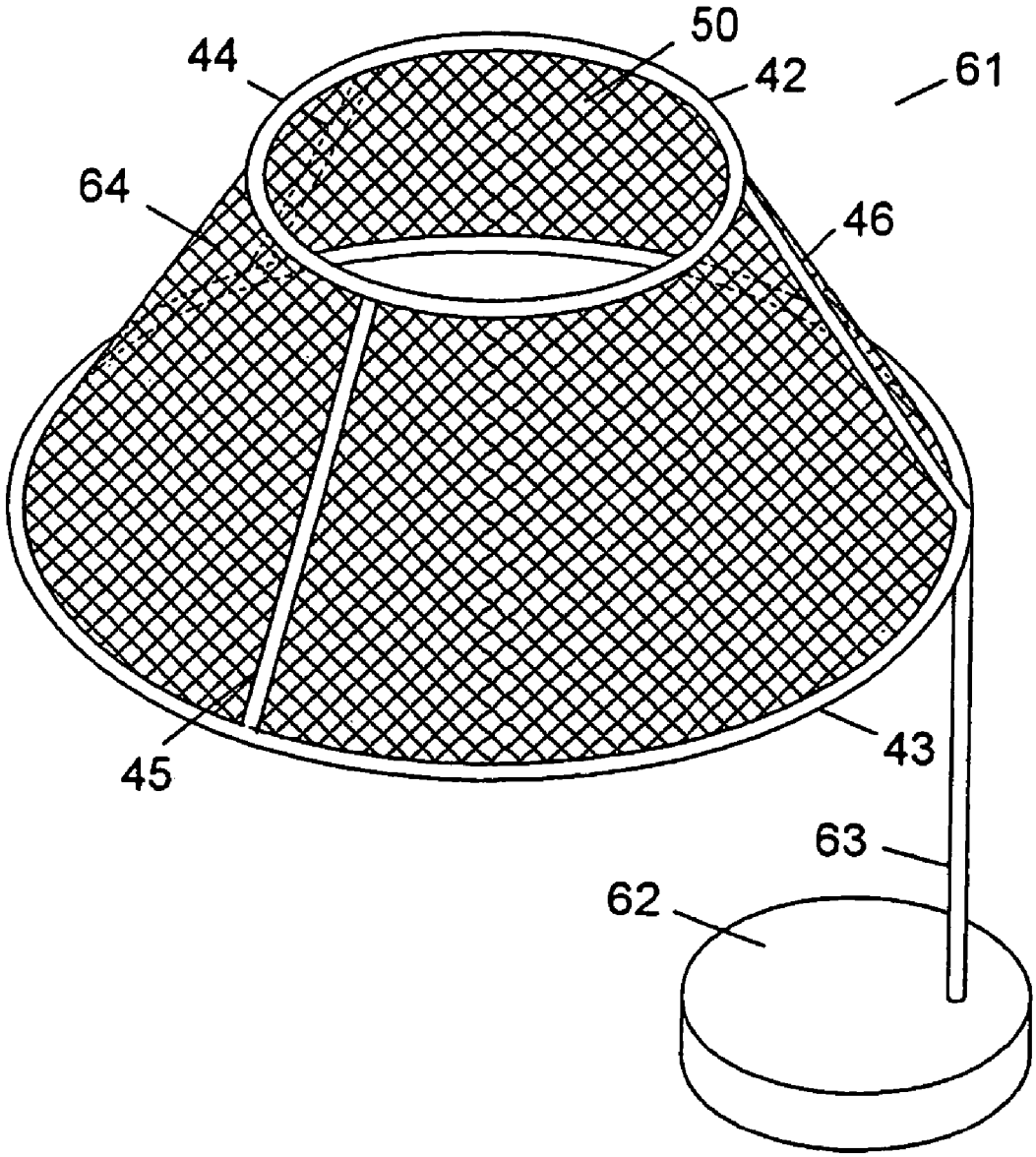
FIG. 8 shows a training device having a peripheral net and being mounted on a single supporting bar.

Another elevated version of the training device 61 is shown in FIG. 8. It differs from the device 51 in two ways. The supporting bar 63 is here connected directly from the lower ring member 43 to the base 62. Of course this type of support is most conveniently used when the device itself is made of a light material, because otherwise the joint between the supporting bar 63 and the lower ring member 43 would be affected by strong forces, which could result in bending of this joint. Anyway, the base 62 must be quite heavy to avoid tilting of the device. The other difference is that a single net 64 is arranged between and along the peripheries of the two rings 42, 43. The net 64 still has the function of catching a ball hitting one of the goal openings defined by the ring members 42, 43 and the connecting bars 44, 45, 46, but an additional effect is that only balls actually hitting the horizontal opening 50 are allowed to enter the interior of the device. Balls missing this opening are guided back to the playing ground by the net 64.

Figure 9:
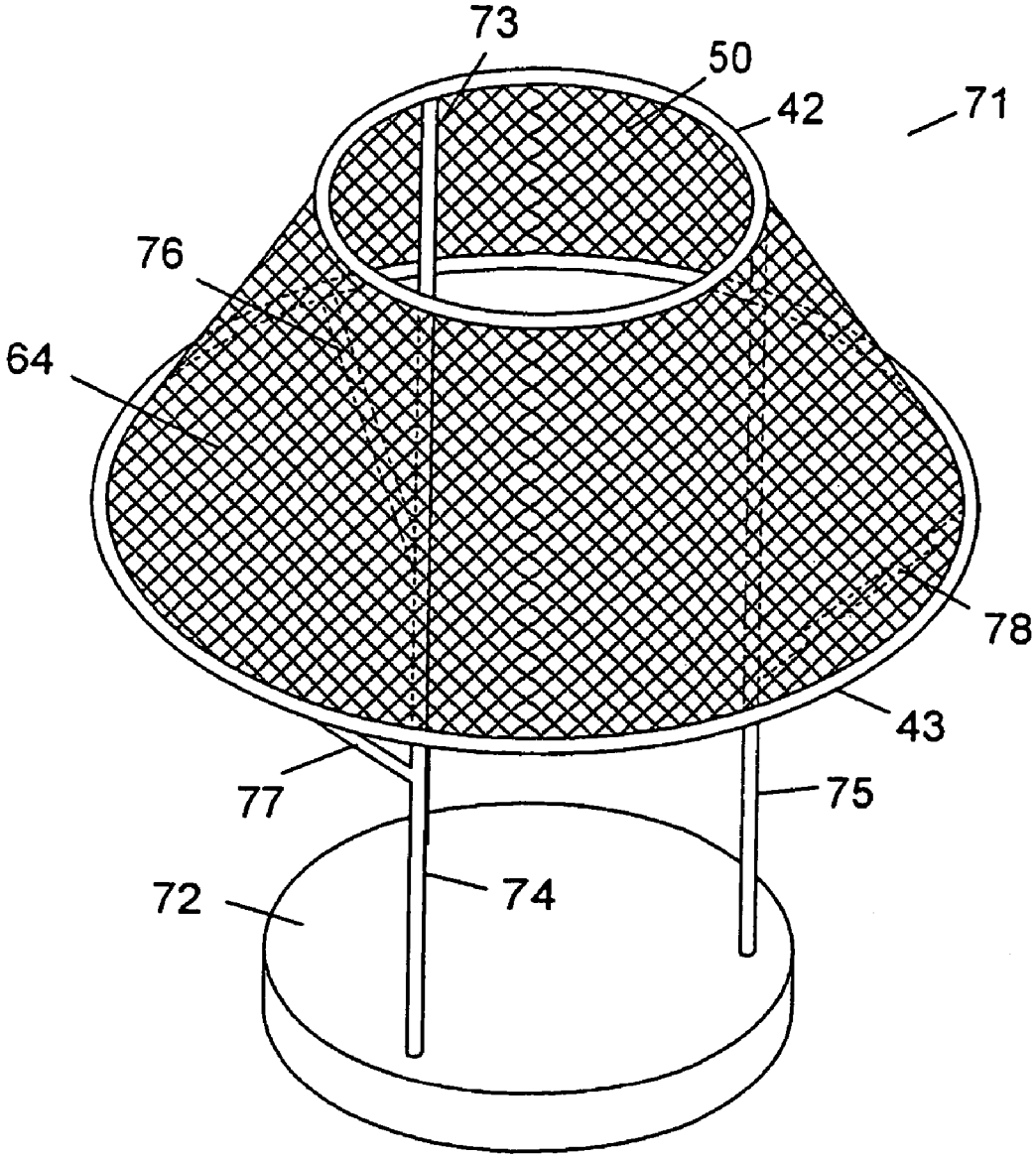
FIG. 9 shows a training device mounted on three supporting bars.

FIG. 9 shows a training device 71 which is a modified version of the device 61 shown in FIG. 8. Instead of the single supporting bar 63 three supporting bars 73, 74, 75 here connect the upper ring member 42 to the base 72, while the lower and larger ring member 43 is connected to the three supporting bars 73, 74, 75 by means of three inclined side bars 76, 77, 78. The function of this device is similar to that of the device 61. Although the training devices 41, 51, 61 and 71 are shown with circular ring members, it is noted that also in these embodiments the ring members may have other shapes, as it was described above.

Figure 10:
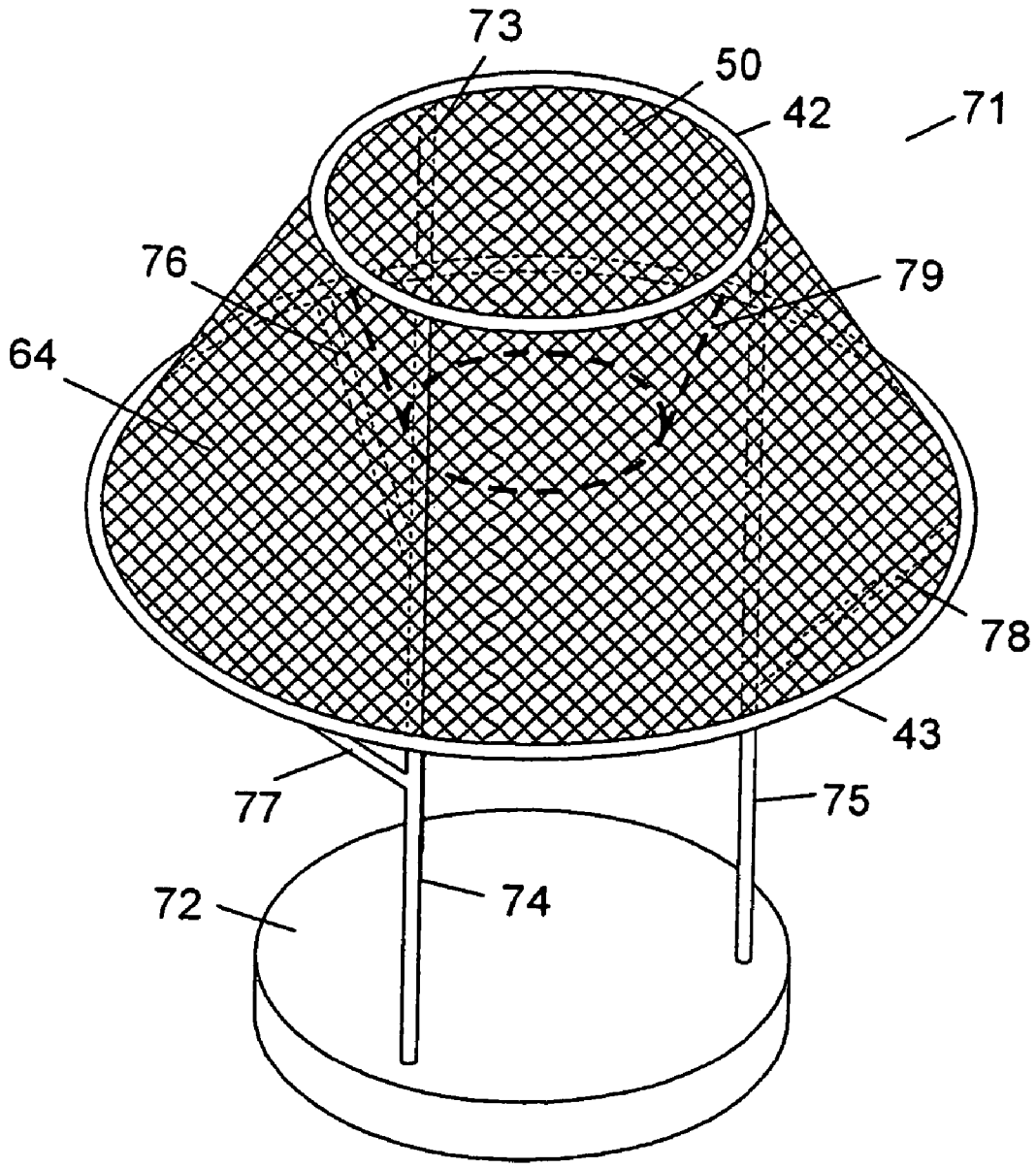
FIG. 10 shows the device of FIG. 9 provided with a basket net.

As shown in FIG. 10, an additional net 79 in the form of a basket as used in basketball may be attached to the upper ring member 42. This basket will guide a ball hitting the horizontal opening 50 to the central part of the interior of the device 71

Figure 11:
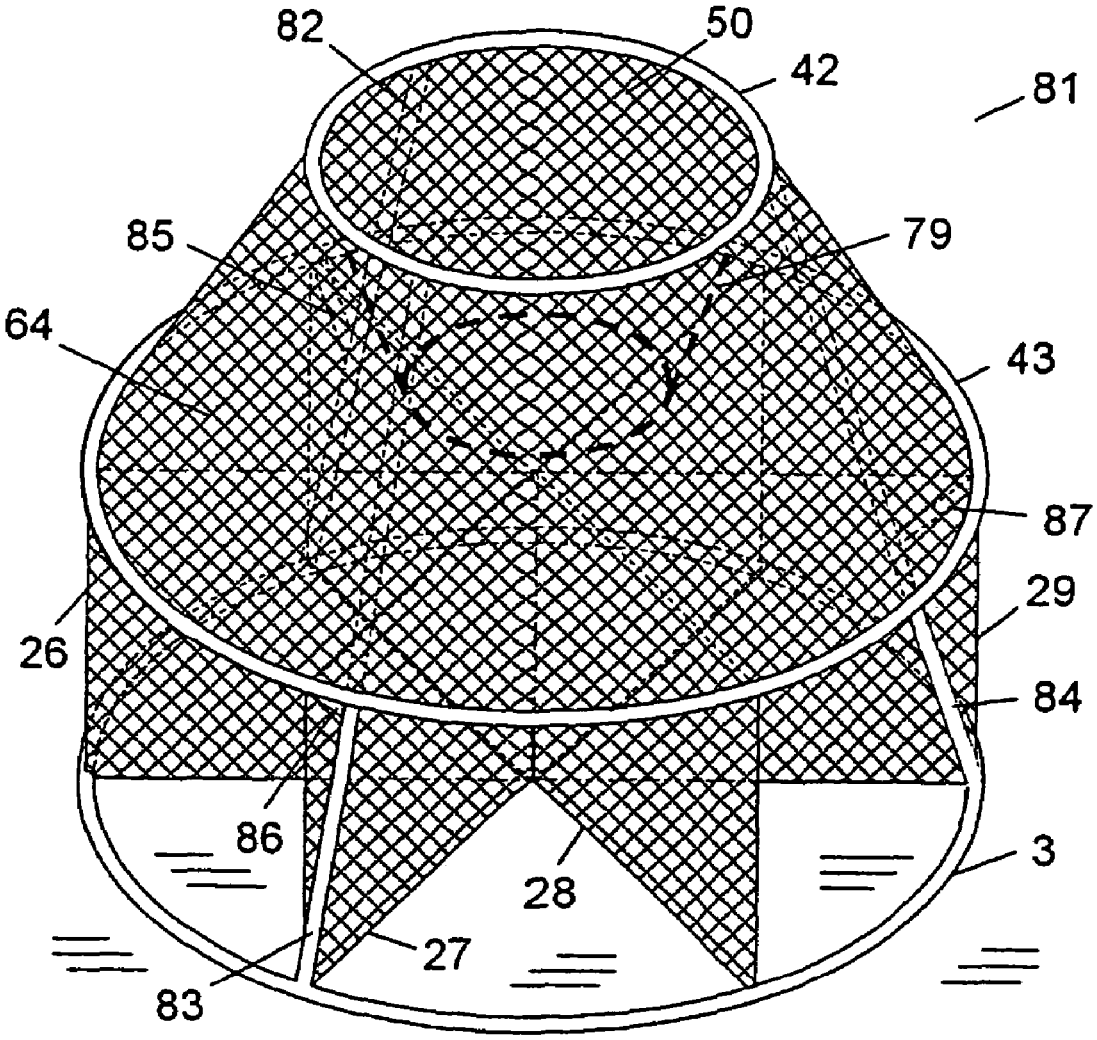
FIG. 11 shows a combined training device.

Some of the embodiments shown above may also be combined. As an example, FIG. 11 shows a training device 81, which is a combination of the training device 21 of FIG. 4 and the training device 71 of FIG. 10. The lower part of the device 81 corresponds to the device 21 with the two relatively large ring members 3, 43 and the six nets 25-30 defining the six goal openings as described before. Similarly, the upper part corresponds to the training device 71 with the smaller ring member 42, the larger ring member 43, the peripheral net 64 and the basket net 79. The three ring members, which are here circular and coaxial, are connected to each other by a number of bars. Three supporting bars 82, 83, 84 connect the lower ring 3 to the smaller upper ring 42, while the central ring 43 is secured to the supporting bars by means of three inclined side bars 85, 86, 87. Of course the number of supporting bars and side bars could be larger or smaller than the three mentioned here.

The training device 81 has many training options. Placed on the ground as shown in FIG. 11, the six goal openings defined by the six nets 25-30 and the two large ring members 3, 43 allow the device to used for training in scoring goals from all sides simultaneously. At the same time the horizontal opening 50 defined by the smaller upper ring member 42 provides training in hitting a relatively small horizontal opening, which is a good exercise in ball handling. The peripheral net 64 ensures that balls not hitting the opening 50 are returned to the playing ground, and of course the net 64 can also be used for scoring goals directly into the net.

If the training device 81 is tilted, the opening 50 in the smaller ring member 42 can be used as a small vertical goal opening, and by rolling the device on the two larger ring members 3, 43 it provides training in hitting a movable goal opening.

Figure 12:
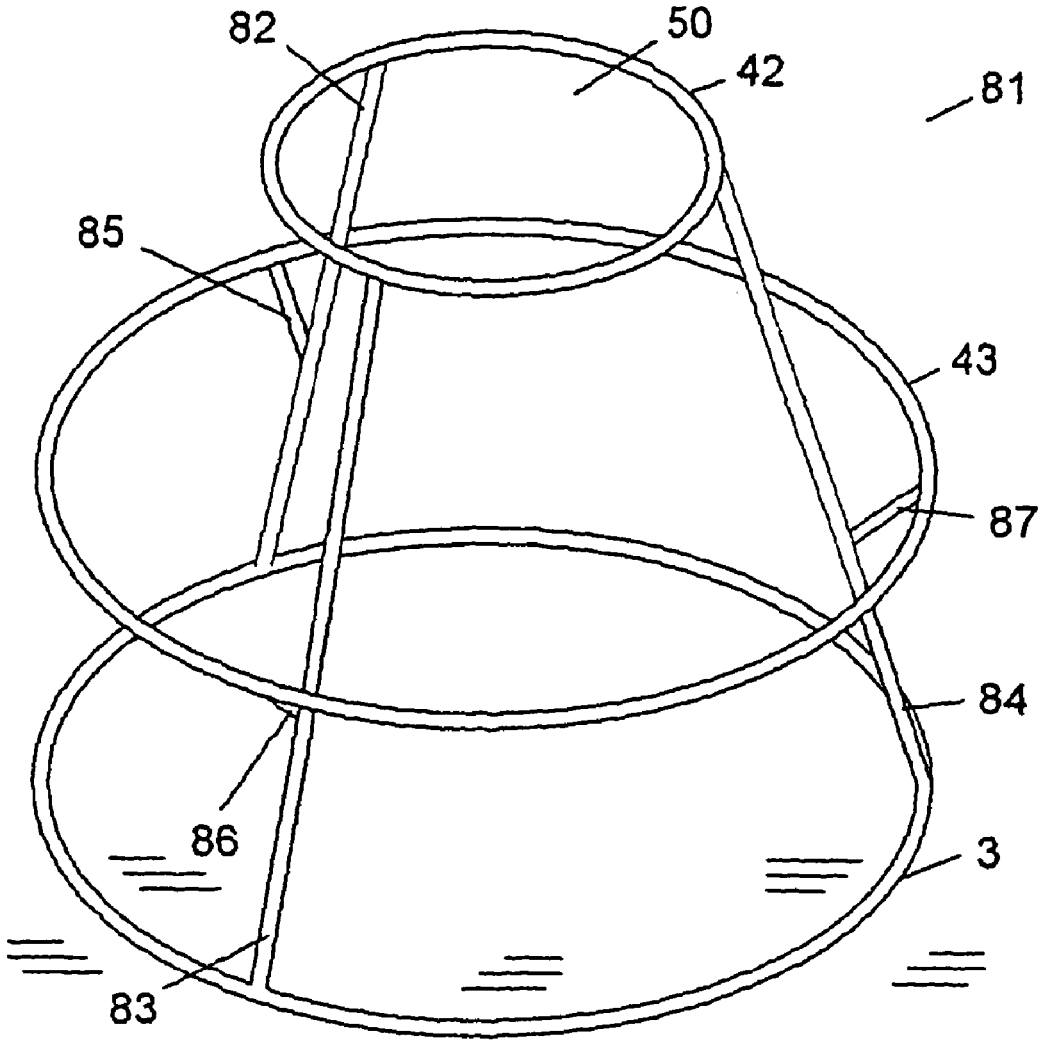
FIG. 12 shows the device of FIG. 11 without the nets.
Figure 13:
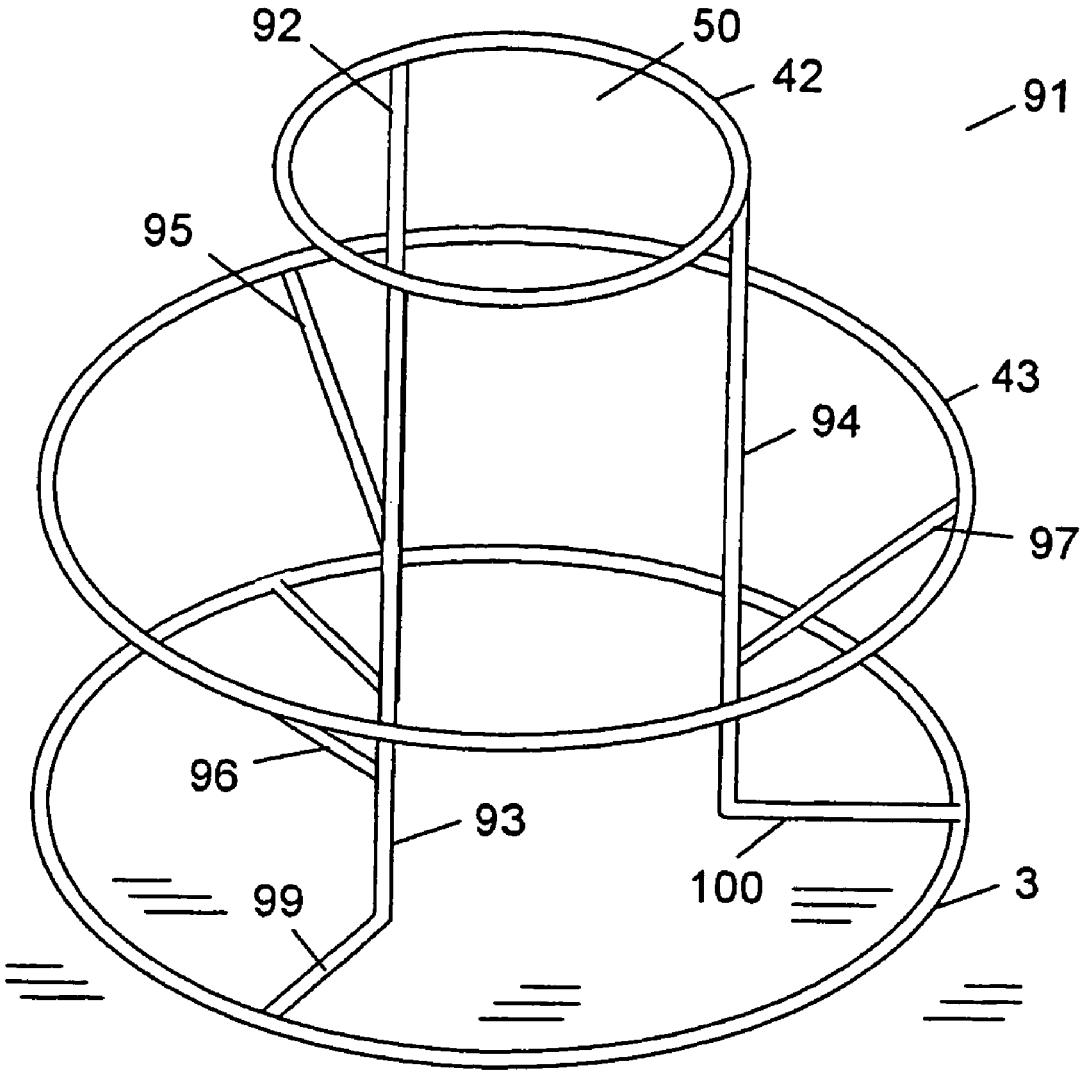
FIG. 13 shows a different version of a training device without nets.

To more clearly illustrate the construction of the training device 81, it is shown in FIG. 12 without the nets. Thus it is easily seen how the ring members 3, 42, 43 are connected to the supporting bars 82, 83, 84 and the side bars 85, 86, 87. The supporting bars could also be vertical as in the device 71 from FIGS. 9 and 10. This is shown in the device 91 in FIG. 13, which is also shown without the nets. The vertical supporting bars 92, 93, 94 are connected directly to the smaller upper ring member 42, while both larger ringer members are connected to the supporting bars with side bars 95, 96, 97 and 98, 99, 100, respectively.

Although a preferred embodiment of the present invention has been described and shown, the invention is not restricted to it, but may also be embodied in other ways within the scope of the subject-matter defined in the following claims.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A training device for ball games comprising:

a first circular ring member arranged in a first plane;

a second circular ring member arranged in a second plane being substantially parallel to said first plane;

each of said first and second rings being of a different size relative to the other;

a plurality of bars connecting said first and second ring members to each other and holding them in a spaced concentric relationship such that said first and second ring members have a common axis, a plurality of openings being defined between the ring members and the bars, said ring members defining an inner space; and at least two nets arranged to catch a ball hitting one of said openings, said nets being suspended in and extending across said inner space between said first and second ring members and being connected to each other in said space along said common axis.

2. The training device according to claim 1, wherein the nets are arranged in planes substantially perpendicular to the plane of at least one ring member.

3. The training device according to claim 1, wherein a larger of said ring members is sufficiently heavy to ensure the stability of the device when the device is placed with said larger ring resting on a substantially horizontal surface.

4. A training device for ball games comprising:

a first ring member arranged in a first plane;

a second ring member arranged in a second plane spaced from and substantially parallel with said first plane;

a plurality of straight bars connecting said first and second ring members to each other in said spaced relationship to define an inner space, spaces between said bars defining a plurality of openings providing access to said inner space;

at least two intersecting nets arranged to catch a ball passing through one of said openings, each of said intersecting nets being suspended in said inner space between said first and second ring members in a plane that is substantially perpendicular to said first and second planes so as to divide said inner space into a plurality of areas, said intersecting nets having a line of intersection that is substantially equal in length to the distance between said first and second ring members.

5. The training device according to claim 4, wherein said first and second ring members share a common axis that is substantially perpendicular to said first and second planes.

6. The training device according to claim 5, wherein said nets passing through said common axis.

7. The training device according to claim 5, wherein at least three intersecting nets are suspended to extend across said inner space, said at least three nets intersecting with one another in said inner space.

8. The training device according to claim 7, wherein said at least three nets intersect with one another along said common axis.

9. The training device according to claim 4, wherein at least one of said ring members has a circular shape.

10. The training device according to claim 4, wherein each of said first and second rings is circular, said rings being held in a spaced concentric relationship by said bars such that said first and second rings have a common axis, said nets being connected to one another along said axis.

11. The training device according to claim 4, wherein at least one of said ring members is polygon shaped.

12. The training device according to claim 4, wherein said first and second rings are substantially the same size.

13. The training device according to claim 4, wherein said first and second rings are different sizes.

14. The training device according to claim 4, wherein one of said ring members is sufficiently heavy to ensure the stability of the device when the device is placed with said sufficiently heavy ring resting on a substantially horizontal surface.

15. The training device according to claim 4, wherein said device further comprises a supporting base arranged distant from said first and second planes.

16. The training device according to claim 4, wherein the device further comprises a third ring member arranged in a third plane being substantially parallel to said first and second planes, said third ring member being smaller than said first and second ring members.

17. The training device according to claim 16, wherein a net is arranged between the peripheries of said third ring member and one of said first and second ring members.

18. The training device according to claim 16, wherein the device further comprises a net formed as a basket and mounted on said third ring member.

19. The training device according to claim 16, wherein said first, second and third ring members are generally circular-shaped and arranged coaxially, said first and third ring members are connected to each other by a plurality of straight connecting bars, said second ring member is arranged between the first and third ring members and is connected to the straight connecting bars by side bars.

20. The training device according to claim 19, wherein a net is arranged between the peripheries of said second and third ring members.

21. A training device for ball games comprising:

a first ring member arranged in a first plane;

a second ring member arranged in a second plane being substantially parallel to said first plane;

a third ring member arranged in a third plane being substantially parallel to said first and second planes, said third ring member being smaller than said first and second ring members;

a plurality of bars connecting said first and second ring members to each other, so that a plurality of openings are defined between the ring members and the bars;

nets arranged to catch a ball hitting one of said openings, said nets being suspended in said inner space between said first and second ring members;

said first, second and third ring members being generally circular-shaped and arranged coaxially, said first and third ring members being connected to each other by a plurality of straight connecting bars, said second ring member being arranged between the first and third ring members and being connected to the straight connecting bars by side bars, nets being arranged between the first and second ring members in planes substantially perpendicular to the plane of at least one ring member, a first net being arranged between the peripheries of said second and third ring members, and a second net formed as a basket being mounted on the third ring member.

22. A training device for ball games comprising:

a base member;

a first ring member arranged in a first plane;

a second ring member arranged in a second plane being substantially parallel to said first plane;

said first and second ring members being generally circular-shaped and arranged coaxially, said first ring member and said base member being connected to each other by a plurality of substantially straight connecting bars, said second ring member being arranged between the first ring member and said base member and being spaced from and connected to the straight connecting bars by angled side bars, said second ring member and said base member defining a plurality of openings; and a plurality of nets arranged to catch a ball hitting one of said openings.

23. The training device according to claim 22, wherein said base member is a third ring.

24. A training device for ball games comprising:

a first ring member arranged in a first plane;

a second ring member arranged in a second plane being substantially parallel to said first plane;

a third ring member arranged in a third plane being substantially parallel to said first and second planes a plurality of straight connecting bars connecting said first and third ring members to each other and holding them in a spaced relationship, said second ring member being arranged between the first and third ring members and being connected to the straight connecting bars by side bars, a plurality of openings being defined between the ring members and the bars, said ring members defining an inner space; and a plurality of nets arranged to catch a ball hitting one of said openings, said nets being suspended in and extending across said inner space and being directly connected to each other in said space and including a first net arranged between the second and third ring members in a plane substantially perpendicular to the plane of at least one ring member, a second net arranged between the peripheries of said first and second ring members, and a third net formed as a basket mounted on the first ring member.

* * * * *